US011503856B2

(12) United States Patent
Zuber et al.

(10) Patent No.: US 11,503,856 B2
(45) Date of Patent: Nov. 22, 2022

(54) SMOKING ARTICLE WITH FRONT-PLUG AND METHOD

(71) Applicant: PHILIP MORRIS PRODUCTS S.A., Neuchatel (CH)

(72) Inventors: Gerard Zuber, Froideville (CH); Thomas Badertscher, Cernier (CH); Cedric Meyer, Lausanne (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 756 days.

(21) Appl. No.: 14/368,083

(22) PCT Filed: Dec. 28, 2012

(86) PCT No.: PCT/EP2012/077092
§ 371 (c)(1),
(2) Date: Jun. 23, 2014

(87) PCT Pub. No.: WO2013/098410
PCT Pub. Date: Jul. 4, 2013

(65) Prior Publication Data

US 2014/0345634 A1 Nov. 27, 2014

(30) Foreign Application Priority Data

Dec. 30, 2011 (EP) ..... 11196204

(51) Int. Cl.
*A24D 3/17* (2020.01)
*A24D 1/20* (2020.01)
*A24D 3/00* (2020.01)

(52) U.S. Cl.
CPC ..... *A24D 3/17* (2020.01); *A24D 1/20* (2020.01); *A24D 3/00* (2013.01)

(58) Field of Classification Search
None
See application file for complete search history.

(56) References Cited

U.S. PATENT DOCUMENTS 2,001,709 A 5/1935 Davidson
2,039,298 A 5/1936 Davidson
(Continued)

FOREIGN PATENT DOCUMENTS

CH 649 032 A5 4/1985
CH 670 420 A5 6/1989
(Continued)

OTHER PUBLICATIONS

U.S. Appl. No. 14/363,093, filed Jun. 5, 2014, Zuber, et al.
(Continued)

*Primary Examiner* — Phu H Nguyen
(74) *Attorney, Agent, or Firm* — Oblon, McClelland, Maier & Neustadt, L.L.P.

(57) ABSTRACT

There is provided a smoking article that includes a plurality of elements, including a front-plug and an aerosol-forming substrate, assembled in contact with a cigarette paper to form a rod. The front-plug is located upstream from the aerosol-forming substrate. In use, a heating element is inserted into the smoking article and the aerosol-forming substrate is heated to generate an aerosol. When the heating element is subsequently withdrawn from the smoking article, the front-plug acts to retain the aerosol-forming substrate within the rod.

5 Claims, 1 Drawing Sheet

(56) References Cited

U.S. PATENT DOCUMENTS 2,164,702 A 7/1939 Davidson
2,827,903 A 3/1958 Niederman
2,852,987 A 9/1958 Eislingen et al.
2,992,648 A 7/1961 Weiss et al.
2,995,481 A 8/1961 Müller
3,122,145 A 2/1964 Louis
3,238,852 A 3/1966 Schur et al.
3,240,213 A 3/1966 Miller
3,246,655 A 4/1966 Spears
3,472,236 A 10/1969 Dearsley
3,518,921 A 7/1970 Müller
3,744,497 A 7/1973 Marciuliano
3,818,809 A 6/1974 Sylvester
3,860,012 A 1/1975 Selke
3,894,544 A 7/1975 Egri
3,894,545 A 7/1975 Crellin et al.
3,957,062 A 5/1976 Labbe et al.
3,991,773 A 11/1976 Walker
4,000,748 A 1/1977 Summers
4,003,684 A 1/1977 Müller et al.
4,007,745 A 2/1977 Randall
4,047,536 A 9/1977 Asfour
4,168,712 A 9/1979 Labbé
4,281,671 A 8/1981 Bynre et al.
4,289,725 A 9/1981 Müller et al.
4,291,711 A 9/1981 Berger
4,355,995 A 10/1982 Berger
4,391,285 A 7/1983 Burnett et al.
4,807,808 A 2/1989 Reed
4,807,809 A 2/1989 Pryor et al.
4,819,665 A 4/1989 Roberts
4,903,714 A 2/1990 Barnes et al.
4,913,169 A 4/1990 Templeton
4,928,714 A 5/1990 Shannon
5,016,656 A 5/1991 McMurtrie et al.
5,027,837 A 7/1991 Clearman et al.
5,033,484 A 7/1991 Seidel et al.
5,101,839 A 4/1992 Jakob et al.
5,105,837 A 4/1992 Barnes et al.
5,144,962 A 9/1992 Counts et al.
5,247,947 A 9/1993 Clearman
5,261,425 A 11/1993 Raker
5,271,419 A 12/1993 Arzonico et al.
5,322,075 A 6/1994 Deevi et al.
5,345,955 A 9/1994 Clearman et al.
5,360,023 A 11/1994 Blakley et al.
5,388,594 A 2/1995 Counts et al.
5,413,121 A 5/1995 Dawson et al.
5,433,224 A 7/1995 Luke et al.
5,469,871 A 11/1995 Barnes et al.
5,499,636 A * 3/1996 Baggett, Jr. ..... A24F 47/008 131/194
5,505,214 A 4/1996 Collins et al.
5,613,584 A 3/1997 Collines et al.
5,671,757 A 9/1997 Woodings
5,685,323 A 11/1997 Crooks et al.
5,692,526 A 12/1997 Adams et al.
5,709,227 A 1/1998 Arzonico et al.
5,724,998 A 3/1998 Gellatly et al.
5,819,751 A 10/1998 Barnes et al.
6,026,820 A 2/2000 Baggett, Jr. et al.
6,385,333 B1 5/2002 Puckett et al.
6,761,175 B2 7/2004 Nakanishi et al.
6,857,431 B2 2/2005 Deevi
7,998,274 B2 8/2011 Rodrigues et al.
2002/0096300 A1 7/2002 Yamashita
2003/0154991 A1 8/2003 Fournier et al.
2004/0110633 A1 6/2004 Deevi et al.
2004/0194792 A1 10/2004 Zhuang et al.
2005/0039767 A1 2/2005 Mua et al.
2005/0066985 A1 3/2005 Borschke et al.
2005/0072438 A1 4/2005 Darwish
2005/0172976 A1 8/2005 Newman et al.
2006/0011206 A1 1/2006 Clarke
2006/0021624 A1 2/2006 Gonterman et al.
2006/0185687 A1 8/2006 Hearn et al.
2007/0023056 A1 2/2007 Cantrell et al.
2007/0235050 A1 10/2007 Li et al.
2008/0029114 A1 2/2008 Seitert et al.
2008/0092912 A1 4/2008 Robinson et al.
2009/0038629 A1 2/2009 Ergle et al.
2009/0044817 A1 2/2009 Besso et al.
2009/0065011 A1 3/2009 Maeder et al.
2009/0301503 A1 12/2009 Peter et al.
2010/0024834 A1* 2/2010 Oglesby ..... A61M 11/041 131/194
2010/0024864 A1 2/2010 Kim et al.
2010/0059070 A1* 3/2010 Potter ..... A24F 47/004 131/194
2010/0059074 A1 3/2010 Brantley et al.
2010/0154809 A1 6/2010 Seitert et al.
2010/0200006 A1 8/2010 Robinson et al.
2010/0275935 A1 11/2010 Fiebelkorn
2010/0313901 A1* 12/2010 Fernando ..... A24F 47/008 131/330
2011/0036364 A1 2/2011 Pienemann et al.
2011/0036367 A1 2/2011 Saito et al.
2011/0155718 A1 6/2011 Greim et al.
2011/0290269 A1 12/2011 Shimizu
2012/0017925 A1 1/2012 Sebastian et al.
2012/0031414 A1 2/2012 Atchley et al.
2012/0048286 A1 3/2012 Luan et al.
2012/0060853 A1 3/2012 Robinson et al.
2012/0060855 A1 3/2012 Fiebelkorn
2012/0067360 A1 3/2012 Conner et al.
2012/0234821 A1 9/2012 Shimizu
2012/0247494 A1 10/2012 Oglesby et al.
2012/0305015 A1 12/2012 Sebastian et al.
2013/0019886 A1 1/2013 White et al.
2014/0305448 A1 10/2014 Zuber et al.
2015/0027474 A1 1/2015 Zuber et al.

FOREIGN PATENT DOCUMENTS

CH 691 156 A5 5/2001
CN 88 1 01084 A 9/1988
CN 1035040 A 8/1989
CN 1059266 A 3/1992
CN 1190335 A 8/1998
CN 1248888 A 3/2000
CN 1262691 A 8/2000
CN 1316205 A 10/2001
CN 1333657 A 1/2002
CN 1113620 C 7/2003
CN 1633247 A 6/2005
CN 1708241 A 12/2005
CN 1744833 3/2006
CN 1961765 A 5/2007
CN 101094599 A 12/2007
CN 101132823 A 2/2008
CN 101263935 A 9/2008
CN 201127292 Y 10/2008
CN 101351128 A 1/2009
CN 101396173 A 4/2009
CN 101437415 A 5/2009
CN 101500441 A 8/2009
CN 101500442 A 8/2009
CN 101500443 A 8/2009
CN 101631478 A 1/2010
CN 201379072 Y 1/2010
CN 101301111 B 6/2010
CN 101778578 A 7/2010
CN 101790329 A 7/2010
CN 101925309 A 12/2010
CN 101970323 A 2/2011
CN 102088875 A 6/2011
CN 102266121 A 12/2011
CN 102392316 A 3/2012
DE 879823 C 6/1953
DE 1 632 239 B1 3/1972
DE 198 54 009 A1 5/2000
EP 0 212 234 A2 3/1987
EP 0 307 090 A1 3/1989
EP 0 340 808 A2 11/1989

(56) References Cited

FOREIGN PATENT DOCUMENTS

| | | | |
|---|---|---|---|
| EP | 0 342 538 | A2 | 11/1989 |
| EP | 0 471 581 | A | 2/1992 |
| EP | 0 476 349 | | 3/1992 |
| EP | 0 503 767 | A1 | 9/1992 |
| EP | 0 532 329 | A2 | 3/1993 |
| EP | 0 535 695 | A2 | 4/1993 |
| EP | 0 530 251 | B1 | 9/1995 |
| EP | 0 777 977 | | 6/1997 |
| EP | 0 822 670 | A2 | 2/1998 |
| EP | 0 822 760 | A2 | 2/1998 |
| EP | 0 608 047 | B1 | 7/1998 |
| EP | 2 062 484 | A1 | 5/2001 |
| EP | 1 889 550 | A1 | 2/2008 |
| EP | 2 025 251 | A1 | 2/2009 |
| EP | 2 100 840 | A1 | 9/2009 |
| EP | 2 289 357 | A1 | 3/2011 |
| EP | 2 340 730 | A1 | 7/2011 |
| EP | 2 394 520 | | 12/2011 |
| EP | 2 757 911 | A1 | 7/2014 |
| GB | 793114 | A | 4/1958 |
| GB | 983928 | | 2/1965 |
| GB | 988811 | A | 4/1965 |
| GB | 994169 | A | 6/1965 |
| GB | 866803 | A | 5/1967 |
| GB | 1 124 434 | | 8/1968 |
| GB | 1151634 | A | 5/1969 |
| GB | 1197174 | | 7/1970 |
| GB | 2 020 158 | A | 11/1979 |
| GB | 2473264 | A | 3/2011 |
| JP | 50-105896 | A | 8/1975 |
| JP | 51-12999 | | 1/1976 |
| JP | 52-10500 | | 1/1977 |
| JP | 64-71470 | | 3/1989 |
| JP | 1-243979 | A | 9/1989 |
| JP | 2-53476 | A | 2/1990 |
| JP | 05-103836 | A | 4/1993 |
| JP | 5-211861 | A | 8/1993 |
| JP | H05-211861 | | 8/1993 |
| JP | H08-256751 | | 10/1996 |
| JP | 9-103280 | | 4/1997 |
| JP | 9-107942 | A | 4/1997 |
| JP | 9-316420 | A | 12/1997 |
| JP | 11-103839 | A | 4/1999 |
| JP | H11-164679 | | 6/1999 |
| JP | 2002-528106 | A | 9/2002 |
| JP | 2006-504431 | | 2/2006 |
| JP | 2008-525009 | | 7/2008 |
| JP | 2009-502194 | A | 1/2009 |
| JP | 2009-529871 | | 8/2009 |
| JP | 2010-506594 | A | 3/2010 |
| JP | 2010-520742 | | 6/2010 |
| JP | 2010-520764 | A | 6/2010 |
| JP | 2010-178730 | A | 8/2010 |
| JP | 2010-535530 | | 11/2010 |
| JP | 2011-509667 | A | 3/2011 |
| JP | 2011-512853 | A | 4/2011 |
| JP | 2011-115141 | A | 6/2011 |
| JP | 2015-517817 | A | 6/2015 |
| JP | 2015-523857 | A | 8/2015 |
| KR | 10-1993-0000048 | A | 1/1993 |
| KR | 1996-0007797 | B1 | 6/1996 |
| KR | 0178388 | B1 | 2/1999 |
| KR | 10-2001-0013020 | | 2/2001 |
| KR | 10-0393327 | B1 | 10/2003 |
| KR | 10-2004-0084899 | | 10/2004 |
| KR | 10-0844445 | B1 | 7/2008 |
| KR | 10-2009-0046820 | A | 5/2009 |
| KR | 10-2010-0054141 | A | 5/2010 |
| KR | 10-2010-0121539 | A | 11/2010 |
| KZ | 11053 | | 12/2001 |
| RU | 2 214 141 | C2 | 10/2003 |
| RU | 2 346 629 | C2 | 2/2009 |
| RU | 2 356 458 | C2 | 5/2009 |
| RU | 2008 131 960 | A | 2/2010 |
| RU | 2 410 993 | C2 | 2/2011 |
| TW | 209162 | | 7/1993 |
| TW | 200934399 | A | 8/2009 |
| TW | 200942185 | A1 | 10/2009 |
| TW | 201012400 | A1 | 4/2010 |
| TW | 201043157 | A1 | 12/2010 |
| UA | 88318 | C2 | 10/2009 |
| WO | WO 94/06314 | A1 | 3/1994 |
| WO | 95/10950 | A2 | 4/1995 |
| WO | 96/32854 | A2 | 10/1996 |
| WO | 96/39880 | A1 | 12/1996 |
| WO | 98/17130 | | 4/1998 |
| WO | 01/89329 | A2 | 11/2001 |
| WO | WO 2004/041007 | A2 | 5/2004 |
| WO | 2005/032285 | A1 | 4/2005 |
| WO | WO 2007/108877 | A2 | 9/2007 |
| WO | WO 2008/015441 | A1 | 2/2008 |
| WO | WO 2008/015570 | A2 | 2/2008 |
| WO | 2008/108889 | A1 | 9/2008 |
| WO | 2009/021018 | A1 | 2/2009 |
| WO | 2009/022232 | | 2/2009 |
| WO | WO 2009/143338 | A2 | 11/2009 |
| WO | 2010/028354 | A1 | 3/2010 |
| WO | 2010/047389 | A1 | 4/2010 |
| WO | 2010/113702 | A1 | 10/2010 |
| WO | WO 2011/045066 | A1 | 4/2011 |
| WO | 2011/068020 | A1 | 6/2011 |
| WO | 2011/077138 | A1 | 6/2011 |
| WO | 2011/101164 | A1 | 8/2011 |
| WO | 2011/141735 | A1 | 11/2011 |
| WO | 2012/012053 | A1 | 1/2012 |
| WO | WO 2012/014490 | A1 | 2/2012 |
| WO | WO 2012/164009 | A2 | 12/2012 |
| WO | WO 2013/076098 | A2 | 5/2013 |
| WO | 2013/098353 | A1 | 7/2013 |
| WO | 2013/098405 | A2 | 7/2013 |
| WO | 2013/098409 | A1 | 7/2013 |
| WO | WO 2013/098410 | A2 | 7/2013 |
| WO | 2013/120566 | A2 | 8/2013 |
| WO | WO 2013/120565 | A2 | 8/2013 |
| WO | 2013/178766 | A1 | 12/2013 |
| WO | 2013/178767 | A1 | 12/2013 |
| WO | 2013/178768 | A1 | 12/2013 |
| WO | 2013/178769 | A1 | 12/2013 |
| WO | WO 2014/102092 | A1 | 7/2014 |

OTHER PUBLICATIONS

International Search Report dated Jul. 5, 2013 in PCT/EP12/077077 filed Dec. 28, 2012.

Written Opinion of the International Searching Authority dated Jul. 5, 2013 in PCT/EP12/077077 filed Dec. 28, 2012.

International Search Report dated Jun. 11, 2013 in PCT/EP12/077091 filed Dec. 28, 2012.

Written Opinion of the International Searching Authority dated Jun. 11, 2013 in PCT/EP12/077091 filed Dec. 28, 2012.

Combined Office Action and Search Report dated Jan. 14, 2016 in Chinese Patent Application No. 201280061528.9 (with English translation only).

Office Action dated Dec. 8, 2015 in Kazakhstani Patent Application No. 2014/1655.1 (English translation only).

International Preliminary Report on Patentability dated Nov. 13, 2014 in PCT/EP213/062869 filed Jun. 20, 2013.

International Search Report dated Nov. 26, 2013 in PCT/EP2013/062869.

Extended Search Report dated Nov. 5, 2012 in European Patent Application No. 12173054.3.

Combined Office Action and Search Report dated Dec. 14, 2015 in Chinese Patent Application No. 201280061532.5 (English translation only).

Office Action dated Mar. 21, 2015 in Korean Patent Application No. 10-2014-7012121 (with English translation only).

Office Action dated Oct. 17, 2016 in Japanese Patent Application No. 2014-549499 (submitting English translation only).

Chinese Office Action dated Mar. 8, 2017(English translation only) received in corresponding Chinese Application No. 201280064910.5, (7 pages).

(56) References Cited

OTHER PUBLICATIONS

Office Action dated Sep. 11, 2017 in European Patent Application No. 12 821 115.8, (5 pages).
English translation only of Chinese Office Action dated Nov. 25, 2016 in corresponding Chinese Application No. 201280061528.9, (4 pages).
Korean Notice of Allowance dated Oct. 31, 2019 in corresponding Korean Patent Application No. 10-2014-7012246, (2 pages).
European Search Report dated Dec. 20, 2019 in European Application No. 19189686.9 (8 pages).
Korean Search Report dated Dec. 16, 2015 in Patent Application No. 10-2014-7036378 (with English translation of Categories of Cited Documents) 11 pages.
Chinese Office Action dated Feb. 13, 2018 in Patent Application No. 201380044053.7 (with English translation), 254 pages.
"Special Filter Rod—Part 1: Acetate Fiber Flute Filter Rod" China Tobacco Industry Standard YC/T 223-1-2007, Jul. 5, 2007, 11 pages.
Jones, S. 0., "Evaluation of Filter Plugs Prepared From 21-Pound Foil Backing Paper Using the RJR Corrugating Machine" RJ Reynolds, RDM, 1958, No. 70, https://www.industrydocuments.ucsf.edu/tobacco/docs/#id=rzxn0096 (Year: 1958).
U.S. Appl. No. 14/378,466, filed Aug. 13, 2014, Zuber, et al.
U.S. Appl. No. 14/378,534, filed Aug. 13, 2014, Jarriault, et al.
U.S. Appl. No. 14/408,132, filed Dec. 15, 2014, Mitrev, et al.
International Search Report dated Feb. 6, 2014 in PCT/EP2012/077092 filed Dec. 28, 2012.
Written Opinion of the International Searching Authority dated Feb. 6, 2014 in PCT/EP2012/077092 filed Dec. 28, 2012.
Office Action dated December in co-pending U.S. Appl. No. 14/402,482, 11 pages.
Combined Chinese Office Action and Search Report dated Dec. 13, 2021 in corresponding Chinese Patent Application No. 201910426523.5 (with English translation), 21 pages.
"Effect of Polyethylene Glycol, Triacetin and Glycerin on the Cellulose Acetate Plasticizing", Korean Polymer Society, vol. 39, No. 4, pp. 649-654 (2015) (R4), http://dx.doi.org/10.7317/pk.2015.39.4.649 (with partial machine English translation), 12 pages.
"Determination of the Draw Resistance of Cigarettes and Filter Rods", Coresta Recommended Method N° 41, Jun. 2007, pp. 1-19.
Office Action dated Mar. 10, 2016 in Chinese Patent Application No. 201280072200.7 (English-language Translation only), 8 pages.
Combined Office Action and Search Report dated Jun. 3, 2016 in Chinese Patent Application No. 201380034575.9 (submitting English translation only), 12 pages.
Combined Chinese Office Action and Search Report dated Jun. 20, 2016 in Patent Application No. 201380034799.X (submitting English translation only), 11 pages.
Combined Chinese Office Action and Search Report dated Jun. 27, 2016 in Patent Application No. 201380034602.2 (submitting English translation only), 11 pages.
Combined Office Action and Search Report dated Jul. 5, 2016 in Chinese Patent Application No. 201380031712.3 (submitting English translation only), 5 pages.
Combined Chinese Office Action and Search Report dated Aug. 2, 2016 in Patent Application No. 201380044053.7 (submitting English translation only), 5 pages.
Combined Search Report and Office Action dated Jan. 4, 2017 in Chinese Patent Application No. 201380031712.3 (English translation only), 7 pages.
Combined Office Action and Search Report dated Feb. 20, 2017 in Chinese Patent Application No. 201380034602.2 (English translation only), 8 pages.
Chinese Office Action received in the corresponding Chinese application No. 201280061528.9 (dated May 3, 2017), 4 pages.
Combined Chinese Office Action and Search Report dated Nov. 13, 2019 in corresponding Chinese Patent Application No. 201711346822.5 (with English Translation), 22 pages.
Combined Chinese Office Action and Search Report dated Dec. 11, 2019, in Patent Application No. 201711347424.5, 21 pages.
Combined Chinese Office Action and Search Report dated Jun. 29, 2020 in corresponding Chinese Patent Application No. 201711346822.5 (with English Translation), 20 pages.
Chinese Office Action dated Jul. 17, 2020 in corresponding Chinese Application No. 201711347424.5 (with English translation), 17 pages.
Extended Search Report dated Oct. 29, 2012 in European patent Application No. 12170358.1, 6 pages.
Extended Search Report dated Oct. 30, 2012, in European Patent Application No. 121703598, 6 pages.
Extended Search Report dated Nov. 27, 2012 in European Patent Application No. 12170360.7, 4 pages.
Extended Search Report dated Mar. 19, 2013 in 12170356.5, 8 pages.
Partial Search Report dated Nov. 30, 2012 in European Patent Application No. 12170356.5, 7 pages.
Office Action dated Dec. 11, 2017 in Europe Patent Application No. 13 726 206.9, 5 pages.
International Search Report dated Sep. 30, 2013 in PCT/EP13/061209 Filed May 30, 2013, 6 pages.
International Search Report and Written Opinion dated Sep. 30, 2013 in PCT/EP2013/061210 filed May 30, 2013, 4 pages.
International Search Report dated Oct. 2, 2013, in PCT/2013/061208 filed May 30, 2013, 2 pages.
International Search Report and Wlitten Opinion dated Oct. 7, 2013 in PCT/EP2013/061211 filed May 30, 2013, 10 pages.
International Search Report dated Oct. 8, 2013, in PCT/EP12/077087 filed Dec. 28, 2012, 8 pages.
International Search Report dated Jan. 24, 2014, in PCT/EP12/077086, filed Dec. 28, 2012, 3 pages.
Written Opinion of the International Searching Authority dated Sep. 30, 2013 in PCT/EP13/061209 Filed May 30, 2013, 3 pages.
Written Opinion dated Oct. 2, 2013 in PCT/EP2013/061208 filed May 30, 2013, 4 pages.
Written Opinion of the International Searching Authority dated Oct. 8, 2013, in PCT/EP12/077087 filed Dec. 28, 2012, 7 pages.
Written Opinion of the International Searching Authority dated Jun. 23, 2014, in PCT/EP12/077086, filed Dec. 28, 2012, 4 pages.
International Preliminary Report on Patentability (IPRP) issued in PCT/EP2012/077086 dated Aug. 14, 2014, 5 pages.
International Preliminary Report on Patentability (IPRP) issued in PCT/EP2012/077087 dated Oct. 29, 2014 , 15 pages.
International Preliminary Report on Patentability dated Dec. 2, 2014 in PCT/EP2013/061209 filed May 30, 2013, 4 pages.
International Preliminary Report on Patentability dated Dec. 2, 2014 in PCT/EP2013/061210 filed on May 30, 2013, 4 pages.
International Preliminary Report on Patentability dated Dec. 2, 2014 in PCT/EP2013/061211 filed May 30, 2013, 6 pages.
International Preliminary Report on Patentability dated Dec. 11, 2014 in PCT/EP2013/061208 filed May 30, 2013, 6 pages.
Israeli Office Action with English translation dated Mar. 13, 2019 in corresponding Israeli Patent Application No. 235629, 7 pages.
Office Action dated Mar. 22, 2016 in Japanese Patent Application No. 2015-517760 (submitting English translation only), 3 pages.
Office Action dated Mar. 29, 2017 in Japanese Patent Application No. 2015-514514 (with unedited computer generated English translation), 7 pages.
Office Action dated Mar. 29, 2017 in Japanese Patent Application No. 2015-514513 (with unedited computer generated English translation), 7 pages.
Office Action dated Mar. 29, 2017 in Japanese Patent Application No. 2015-514511 (with unedited computer generated English translation), 8 pages.
English language translation only of Japanese Office Action dated Apr. 17, 2017 in corresponding Japanese Patent Application No. 2015-514512, 5 pages.
Office Action dated Dec. 6, 2017 in Japanese Patent Application No. 2015-514511 (with English language translation), 8 pages.
Japanese Pre-Appeal Review report with English translation dated Feb. 27, 2018 in corresponding Japanese Patent Application No. 2015-514514, 4 pages.
Office Action dated Feb. 28, 2018 in Japanese Patent Application No. 2015-514512 (with English language translation), 6 pages.

(56) References Cited

OTHER PUBLICATIONS

Japanese Office Action with English translation dated Dec. 17, 2018 in corresponding Japanese Patent Application No. 2017-250915, 7 pages.
Japanese Office Action with English translation dated Aug. 30, 2019 in corresponding Japanese Patent Application No. 2018-122637, 8 pages.
Office Action dated Aug. 23, 2016 in Kazak Patent Application No. 2014/2552.1 (submitting English translation only), 3 pages.
Notice of Allowance dated Apr. 7, 2016 in Korean Patent Application No. 10-2014-7024000 (English-language Translation only), 1 page.
Korean Office Action dated Apr. 8, 2016 in Patent Application No. 10-2014-7036378 (English translation only).
Korean Notice of Allowance dated Jun. 24, 2020 in corresponding Korean Application No. 10-2014-7033532 (with English translation), 3 pages.
Korean Notice of Allowance dated Jun. 25, 2020 in corresponding Korean Application No. 10-2014-7034539 (with English translation), 3 pages.
New Zealand Office Action dated Nov. 10, 2015 in Patent Application No. 703078, 3 pages.
Office Action dated Jul. 29, 2016 in Russian Patent Application No. 2015101642/12(002456) (submitting English translation only), 4 pages.
English translation only of Decision to Grant dated Apr. 24, 2017 and received in corresponding Russian Application No. 2014153579/12(085605), 4 pages.
Russian Office Action dated Jun. 8, 2017 In Patent Application No. 2014153639 (with English Translation), 11 pages.
Russian Office Action dated Jun. 23, 2017 in Patent Application No. 2014153008 (with English Translation), 11 pages.
Combined Office Action and Search Report dated Apr. 19, 2017 in Taiwanese Patent Application No. 102121900 (submitting English translation only), 4 pages.
Taiwanese Search Report with English translation dated Jul. 10, 2017 in the corresponding Taiwanese Patent Application No. 101151338, 10 pages.
Chinese Office Action dated Jul. 10, 2020 in corresponding Chinese Application No. 201810597257.8 (with English translation), 19 pages.
China Tobacco Yearbook: 1998-1999 (vol. 2) (compiled by the State Tobacco Monopoly Administration, Beijing: The Economic Daily Press, Dec. 2000, pp. 573-574).
Chinese Office Action dated Feb. 23, 2021 in corresponding Chinese Patent Application No. 201810597257.8 (with English translation), 19 pages.
Zhang Huailing, et al., "Blended Type Cigarettes, First Edition", China Light Industry Press, Nov. 30, 1997, 6 pages.
Oficial Action (Notice of Hearing) issued in corresponding Indian Patent Application No. 4027/DELNP/14 (with English translation), 3 pages.
Chinese Office Action dated Jun. 25, 2021, in corresponding Chinese Patent Application No. 20191062233.8 (with English translation), 19 pages.
Combined Chinese Office Action and Search Report dated Apr. 1, 2021 in corresponding Chinese Patent Application No. 201910426523.5 (with English translation), 21 pages.

* cited by examiner

SMOKING ARTICLE WITH FRONT-PLUG AND METHOD

CROSS REFERENCE TO RELATED APPLICATION

This application is a national phase application based on PCT/EP2012/077092, filed on Dec. 28, 2012.

The present specification relates to a smoking article comprising an aerosol-forming substrate for generating an inhalable aerosol when heated by a heating element. The specification also relates to a method of using such a smoking article.

Smoking articles in which an aerosol-forming substrate, such as a tobacco containing substrate, is heated rather than combusted are known in the art. The aim of such heated smoking articles is to reduce known harmful smoke constituents produced by the combustion and pyrolytic degradation of tobacco in conventional cigarettes. Typically in such heated smoking articles, an aerosol is generated by the transfer of heat from a heat source to a physically separate aerosol-forming substrate or material, which may be located within, around or downstream of the heat source. During smoking, volatile compounds are released from the aerosol-forming substrate by heat transfer from the heat source and entrained in air drawn through the smoking article. As the released compounds cool, they condense to form an aerosol that is inhaled by the consumer.

A number of prior art documents disclose aerosol-generating devices for consuming or smoking heated smoking articles. Such devices include, for example, heated smoking systems and electrically heated smoking systems. One advantage of these systems is that they significantly reduce sidestream smoke, while permitting the smoker to selectively suspend and reinitiate smoking. An example of a heated smoking system is disclosed in U.S. Pat. No. 5,144,962, which includes in one embodiment a flavour-generating medium in contact with a heater. When the flavour-generating medium is exhausted, both the flavour-generating medium and the heater are replaced. An aerosol-generating device where a smoking article can be replaced without the need to remove the heating element is desirable.

Typically, smoking articles for use with aerosol-generating devices comprise an aerosol-forming substrate that is assembled, often with other elements or components, in the form of a rod. Typically, such a rod is configured in shape and size to be inserted into an aerosol-generating device that comprises a heating element for heating the aerosol-forming substrate.

Direct contact between a heating element, for example an electrically actuated heating element, and the aerosol-forming substrate may provide an efficient means for heating the aerosol-forming substrate to form an inhalable aerosol. In such a device configuration, heat from a heating element may be conveyed almost instantaneously to at least a portion of the aerosol-forming substrate when the heating element is actuated, and this may facilitate the rapid generation of an aerosol. Furthermore, the overall heating energy required to generate an aerosol may be lower than would be the case in a system where the aerosol-forming substrate does not directly contact a heating element and initial heating of the aerosol-forming substrate occurs by convection or radiation. Where a heating element is in direct contact with an aerosol-forming substrate, the initial heating of portions of the aerosol-forming substrate that are in contact with the heating element will be effected by conduction.

Direct contact between a heating element and an aerosol-forming substrate may result in shrinkage of the aerosol-forming substrate. Shrinkage of the aerosol-forming substrate due to thermal contractions may cause the aerosol-forming substrate to adhere to a heating element. This may make it difficult to remove the smoking article from the heating element. The problems of adherence between a heating element and an aerosol-forming substrate may be particularly pronounced when the aerosol-forming substrate is in the form of a gathered sheet of homogenised tobacco material. Heating of such a substrate may be achieved by insertion of a heating element into the folds of the gathered sheet material. Shrinkage of such a substrate during heating may then cause the substrate to grip the heating element tightly, making it difficult to cleanly remove the heating element from the substrate.

Shrinkage of the aerosol-forming substrate may also loosen the aerosol-forming substrate within the smoking article. A preferred embodiment of a smoking article may be formed from a number of cylindrical elements arranged in sequence and assembled by wrapping with a cigarette paper. The cigarette paper retains the elements in position by an interference interaction. Within the smoking article, the aerosol-forming substrate, or a cylindrical plug comprising the aerosol-forming substrate, is retained by contact with the cigarette paper. Shrinkage of the aerosol-forming substrate during heating may mean that the aerosol-forming substrate, or a portion thereof, is more likely to be removed from the rod of the smoking article when the smoking article is withdrawn from the heating element. This would result in the need to clean the aerosol-generating device comprising the heating element before the aerosol-generating device could be used to smoke another smoking article. An aerosol-forming substrate that is stuck to a heating element will provide a physical barrier to the re-use of the heating element as it may prevent the heating element being inserted into a new smoking article.

It is also undesirable for small portions of aerosol-forming substrate and residues of aerosol-forming substrate to remain in contact with the heating element as these may decompose over prolonged heating and produce unpleasant flavours that are detectable by a user.

As used herein, the terms 'aerosol-generating article' and 'smoking article' refer to an article comprising an aerosol-forming substrate that is capable of releasing volatile compounds that can form an aerosol. For example, an aerosol-generating article may be a smoking article that generates an aerosol that is directly inhalable into a user's lungs through the user's mouth. An aerosol-generating article may be disposable.

As used herein, an aerosol-generating article is a heated aerosol-generating article, which is an aerosol-generating article comprising an aerosol-forming substrate that is intended to be heated rather than combusted in order to release volatile compounds that can form an aerosol. The aerosol formed by heating the aerosol-forming substrate may contain fewer known harmful constituents than would be produced by combustion or pyrolytic degradation of the aerosol-forming substrate. An aerosol-generating article may comprise, a tobacco stick.

As used herein, an 'aerosol-generating device' relates to a device that interacts with an aerosol-forming substrate to generate an aerosol. The aerosol-forming substrate forms part of an aerosol-generating article, for example part of a smoking article. An aerosol-generating device may comprise one or more components used to supply energy from a power supply to an aerosol-forming substrate to generate an aerosol.

An aerosol-generating device may be described as a heated aerosol-generating device, which is an aerosol-generating device comprising a heater. The heater is preferably used to heat an aerosol-forming substrate of an aerosol-generating article to generate an aerosol.

An aerosol-generating device may be an electrically heated aerosol-generating device, which is an aerosol-generating device comprising a heater that is operated by electrical power to heat an aerosol-forming substrate of an aerosol-generating article to generate an aerosol. An aerosol-generating device may be a gas-heated aerosol-generating device. An aerosol-generating device may be a smoking device that interacts with an aerosol-forming substrate of an aerosol-generating article to generate an aerosol that is directly inhalable into a user's lungs thorough the user's mouth.

As used herein, the term 'aerosol-forming substrate' relates to a substrate capable of releasing volatile compounds that can form an aerosol. Such volatile compounds may be released by heating the aerosol-forming substrate. An aerosol-forming substrate may be adsorbed, coated, impregnated or otherwise loaded onto a carrier or support. An aerosol-forming substrate may conveniently be part of an aerosol-generating article or smoking article.

An aerosol-forming substrate may comprise nicotine. An aerosol-forming substrate may comprise tobacco, for example may comprise a tobacco-containing material containing volatile tobacco flavour compounds, which are released from the aerosol-forming substrate upon heating. In preferred embodiments an aerosol-forming substrate may comprise homogenised tobacco material, for example cast leaf tobacco.

The specification relates to a smoking article and a method of using a smoking article. In one embodiment, a smoking article comprising a plurality of elements assembled in contact with a cigarette paper to form a rod is provided. The elements assembled in contact with the cigarette paper to form the rod include a front-plug and an aerosol-forming substrate. The rod can be defined as having a mouth end and a distal end located upstream from the mouth end. The front-plug is located upstream of the aerosol-forming substrate within the rod.

In use, a user applies his or her lips to the mouth end of the rod and inhales. Air and any aerosol generated within the rod are drawn through the mouth end of the rod to be inhaled by the user. When the user inhales, air and aerosol move through the rod in a direction generally from the distal end to the mouth end of the rod. In some embodiments, air may be drawn into the rod through the distal end of the rod. In some embodiments, air may be drawn into the rod through a sidewall of the rod. In other embodiments, air may be drawn into the rod through a combination of the distal end of the rod and a sidewall of the rod.

For simplicity, the terms "upstream" and "downstream" as used herein refer to a relative position along the rod of the smoking article with reference to the direction in which the aerosol is drawn through the rod. Any element or component that is closer to the distal end from a particular reference point can be defined as upstream from that point. Likewise, any element or component that is closer to the mouth end from a reference point can be defined as downstream from that point. In this embodiment, the front-plug is located closer to the distal end of the rod than the aerosol-forming substrate. Thus, the front-plug can be defined as being upstream of the aerosol-forming substrate.

In some embodiments, the smoking article may comprise further elements. For example, the article may further comprise a filter, such as a mouthpiece filter, located downstream of the aerosol-forming substrate. Preferably, such a filter is located at the mouth end of the rod. If present, a filter is preferably assembled along with the front-plug and the aerosol-forming substrate in the rod. Suitable filters may be made from any suitable filter material. Many such filter materials are known in the art, for example a suitable filter may be made from a length of cellulose acetate tow. Other elements such as free-flow filters and spacers may also be assembled in contact with the cigarette paper as part of the smoking article.

One advantage of the front-plug is that it may prevent egress of the aerosol-forming substrate from the distal end of the rod during handling and shipping. Another advantage of the front-plug is that it may assist location of the aerosol-forming substrate at a predetermined distance from the distal end of the rod for optimum engagement with a heat source such as a heating element.

Preferred embodiments are smoking articles for use with an aerosol-generating device comprising one or more heating elements that are configured to contact the aerosol-forming substrate. For the avoidance of doubt, in the following description the term heating element is used to mean one or more heating elements.

It may be preferable for the front-plug to be penetrable by the heating element so that the heating element can contact or penetrate the aerosol-forming substrate. In such embodiments, the aerosol-forming substrate may shrink into contact with a heating element during an aerosol-generating phase. The aerosol-forming substrate may also shrink such that its contact with the cigarette paper is reduced. Without a front-plug, the withdrawal of the heating element from the rod may also result in the withdrawal of the aerosol-forming substrate due to increased adhesion of the aerosol-forming substrate with the heating element coupled with decreased adhesion of the aerosol-forming substrate with the cigarette paper. However, the front-plug may facilitate removal or extraction of the heating element from the rod by restricting the movement of the aerosol-forming substrate towards the distal end of the rod. The front-plug blocks the passage of the aerosol-forming substrate and therefore prevents the aerosol-forming substrate from being withdrawn from the rod.

The front-plug may be made from a filter material that allows air to be drawn through the front plug. This may allow a user to draw air through the rod via the front-plug. The front-plug may conveniently be formed from the same material as a conventional mouthpiece filter. For example, the front-plug may be formed from a length of cellulose acetate tow. Permeability of the front-plug may be varied to help control resistance to draw through the smoking article. Alternatively, the front-plug may be formed from a material that is not permeable to air. In such embodiments, the smoking article may be configured such that air flows into the rod through a sidewall. Optionally, the air drawn into the rod through a sidewall may enter through the cigarette paper or through pores defined through the cigarette paper.

The front-plug may comprise one or more materials selected from the group comprising ceramic, polymer, biopolymer, metal, zeolite, paper, cardboard, inert material, and inorganic material. The front-plug has a diameter that is approximately equal to the diameter of the smoking article. Preferably, the front-plug has a diameter between about 5 millimetres and about 10 millimetres. The front-plug has a length that may be defined as the dimension along the longitudinal axis of the smoking article. The length of the front-plug may be between about 1 millimetre and about 10 millimetres, for example between about 4 millimetres and about 8 millimetres. It is preferred that the front-plug is substantially cylindrical has a length of at least 2 millimetres in order to facilitate assembly of a smoking article, preferably at least 3 mm or at least 4 mm. A longer plug may also provide an improved cleaning effect as there is a greater amount of the front plug material available for wiping the heating element as the heating element is withdrawn from the plug. It is preferable that the diameter of the plug is greater than 5 mm, for example between 6 mm and 8 mm.

In some embodiments, the front-plug may be partially or entirely formed from an aerosol-forming substrate. For example, the aerosol-forming substrate may be a material comprising tobacco or processed tobacco and the front-plug may comprise this material. If an aerosol-forming substrate is incorporated in the front-plug, the density of the aerosol-forming substrate may be increased at the distal end of the rod to allow the aerosol-forming substrate to function as a front-plug.

Some embodiments of the smoking article are designed to be used in conjunction with an aerosol-generating device having a heating element for heating the aerosol-forming substrate. Such heating elements are typically in the form of pins or blades that can be inserted into the smoking article through the front-plug. To facilitate this, the front-plug may have physical properties that facilitate the insertion of a heating element. For example, the front-plug may be formed from a low strength material such as a bundle of fibres or polymeric foam. A front-plug formed from a bundle of fibres may have fibres aligned in a direction that is longitudinal with respect to the rod in order to reduce insertion force required to insert a heating element into the smoking article in a longitudinal direction.

The front-plug may define a hole or slit to allow a heating element to pass therethrough. A heating element is then able to contact or penetrate the aerosol-forming substrate with a low insertion force required to penetrate the front-plug. A hole defined through a front-plug may be dimensioned to engage with a heating element inserted therethrough. For example, the size and shape of the hole defined through the front-plug may almost exactly match the size and shape of a cross-section of the heating element. The hole may have smaller dimensions than the heating element, or may be a slit. In such embodiments, the heating element may need to deform the material of the front-plug in order to penetrate the front-plug. Any hole defined through the front-plug may be cylindrical or prismatic in shape. For example, the hole defined through the front-plug may be shaped like a circular cylinder or a hexagonal cylinder. Any slit defined through the front-plug may be a single slit or multiple slits.

The material forming the front-plug may be a resilient material or a partially resilient material that may be deformed by insertion of a heating element and regain its shape when the heating element is removed. Thus, where a heating element pierces the front-plug, the material of the front-plug may deform to allow access to the heating element. When the heating element is removed, the hole pierced through the front-plug may close or partially close. An advantage of such embodiments may be that the front-plug wipes the heating element as the element is withdrawn from the smoking article. This may help remove any fragments of the aerosol-forming substrate that have adhered to the heating element, and may help clean any volatile compounds that have been deposited on the heating element. The heating element may, therefore, be cleaned every time the heating element is removed from a smoking article.

The front-plug does not need to be formed from a resilient material in order to provide cleaning functionality. For example, if a hole through a front-plug is dimensioned to almost exactly match a cross-section of a heating element, then some cleaning functionality may be provided on withdrawal of the heating element. Likewise, if the front-plug defines a slit through which the heating element may pass the front-plug material surrounding the slit is deflected when a heating element is inserted. Subsequent withdrawal of the heating element may also result in interference between the heating element and the material surrounding the slit, which may provide cleaning or wiping of the heating element.

The front-plug may have more than one hole or slit defined through it. For example, if the smoking article is intended to be used with an aerosol-generating device having three heating pins, the front-plug of a compatible smoking article may comprise three holes arranged to accept the passage of the heating pins.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghetti strands, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form, or may be provided in a suitable container or cartridge. For example, the aerosol-forming material of the solid aerosol-forming substrate may be contained within a paper or other wrapper and have the form of a plug. Where an aerosol-forming substrate is in the form of a plug, the entire plug including any wrapper is considered to be the aerosol-forming substrate.

Optionally, the solid aerosol-forming substrate may contain additional tobacco or non-tobacco volatile flavour compounds, to be released upon heating of the solid aerosol-forming substrate. The solid aerosol-forming substrate may also contain capsules that, for example, include the additional tobacco or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, spaghetti strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

In preferred embodiments the aerosol-forming substrate comprises one or more sheets of homogenised tobacco material that has been gathered into a rod, circumscribed by a wrapper, and section to provide individual plugs of aerosol-forming substrate.

The cigarette paper may be any suitable non-tobacco material for wrapping components of a smoking article in the form of a rod. The cigarette paper needs to grip the component elements of the smoking article when the article is assembled and hold them in position within the rod. Suitable materials are well known in the art.

The smoking article may be substantially cylindrical in shape. The smoking article may be substantially elongate. The smoking article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length. The aerosol-forming substrate may be received in the aerosol-generating device such that the length of the aerosol-forming substrate is substantially parallel to the airflow direction in the aerosol-generating device.

The smoking article may have a total length between approximately 30 millimetres and approximately 100 millimetres. The smoking article may have an external diameter between approximately 5 millimetres and approximately 12 millimetres. The smoking article may comprise a filter or mouthpiece. The filter may be located at the downstream end of the smoking article. The filter may be a cellulose acetate filter plug. The filter is approximately 7 millimetres in length in one embodiment, but may have a length of between approximately 5 millimetres to approximately 14 millimetres.

In one embodiment, the smoking article has a total length of approximately 45 millimetres. The smoking article may have an external diameter of approximately 7.2 millimetres. Further, the aerosol-forming substrate may have a length of approximately 10 millimetres. Alternatively, the aerosol-forming substrate may have a length of approximately 12 millimetres. Further, the diameter of the aerosol-forming substrate may be between approximately 5 millimetres and approximately 12 millimetres. Further, the smoking article may comprise a separation between the aerosol-forming substrate and the filter plug. The separation may be approximately 18 millimetres, but may be in the range of approximately 5 millimetres to approximately 25 millimetres.

In another embodiment, a method of using, consuming or smoking a smoking article comprising a plurality of elements assembled in the form of a rod is provided. The elements assembled to form the rod include a front-plug and an aerosol-forming substrate. The method involves the steps of inserting a heating element into the smoking article through the front-plug, raising the temperature of the heating element to heat the aerosol-forming substrate sufficiently to form an aerosol, and withdrawing the heating element from the smoking article.

The aerosol generated by heating the aerosol-forming substrate may be inhaled by the user. The rod can be defined as having a mouth end and a distal end located upstream from the mouth end. Typically, a user applies his or her lips to the mouth end of the rod and inhales at the same time as the aerosol-forming substrate is heated by the heating element. Air and any aerosol generated within the rod are drawn through the mouth end of the rod to be inhaled by the user.

In some embodiments, the heating element is brought into direct contact with the aerosol-forming substrate, and in some embodiments, the heating element is inserted into the aerosol generating substrate. As described above, the aerosol-forming substrate may adhere to the heating element. The aerosol-forming substrate may also contract after heating which may cause it to loose contact with the cigarette paper and become loose within the rod. In such circumstances, the aerosol-forming substrate is susceptible to being withdrawn from the rod when the heating element is withdrawn. Thus, the method may provide a step in which the front-plug prevents egress of the aerosol-forming substrate as the heating element is withdrawn from the smoking article. The aerosol-forming substrate may move within the rod towards the front-plug and impinge the front-plug. This impingement may allow the adherence between the heating element and the aerosol-forming substrate to be overcome, thereby allowing the heating element to be withdrawn from the smoking article.

The method may involve a step in which the heating element pierces the front-plug. The heating element may be in the form of a pin or blade and may have a sharpened end to allow the piercing of the front-plug.

The method may involve a step in which the heating element is inserted through a hole or slit defined in the front-plug.

As described above, fragments of aerosol-forming substrate may adhere to the heating element. Furthermore, residues of the aerosol-forming substrate or residues derived from the aerosol-forming substrate may be deposited or formed on the heating element. The method may involve a step in which a surface of the heating element is wiped as the heating element is withdrawn from the smoking article. Such wiping is effected by interference between a surface of the heating element and the material forming the front-plug.

The heating element will typically be a heating element of an aerosol-generating device compatible with the smoking article. Features described in relation to one embodiment may also be applicable to other embodiments. For example, the method of using a smoking article may be used in conjunction with any smoking article described above.

Specific embodiments will now be described with reference to the figures, in which.

Figure 3:
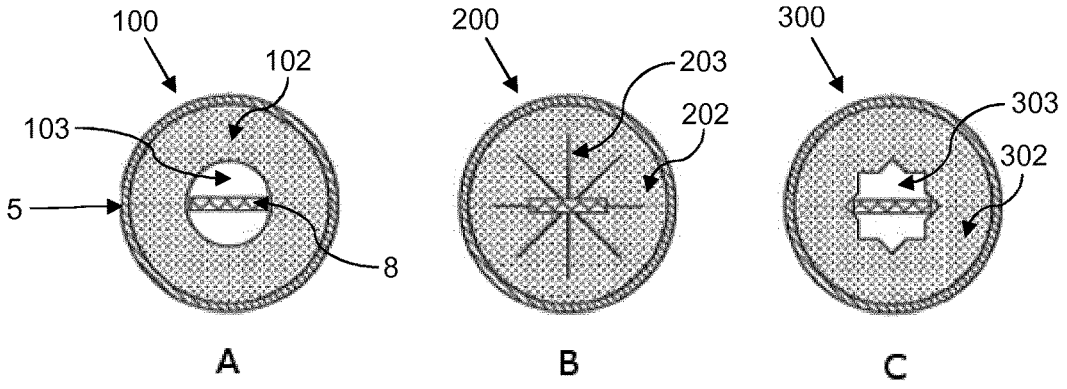
FIG. 3A is a schematic diagram illustrating a front-end projection of a smoking article according to a second embodiment, showing penetration of the front-plug of the smoking article by a heating element.

FIG. 3B is a schematic diagram illustrating a front-end projection of a smoking article according to a third embodiment, showing penetration of the front-plug of the smoking article by a heating element; and FIG. 3C is a schematic diagram illustrating a front-end projection of a smoking article according to a fourth embodiment, showing penetration of the front-plug of the smoking article by a heating element.

Figure 1:
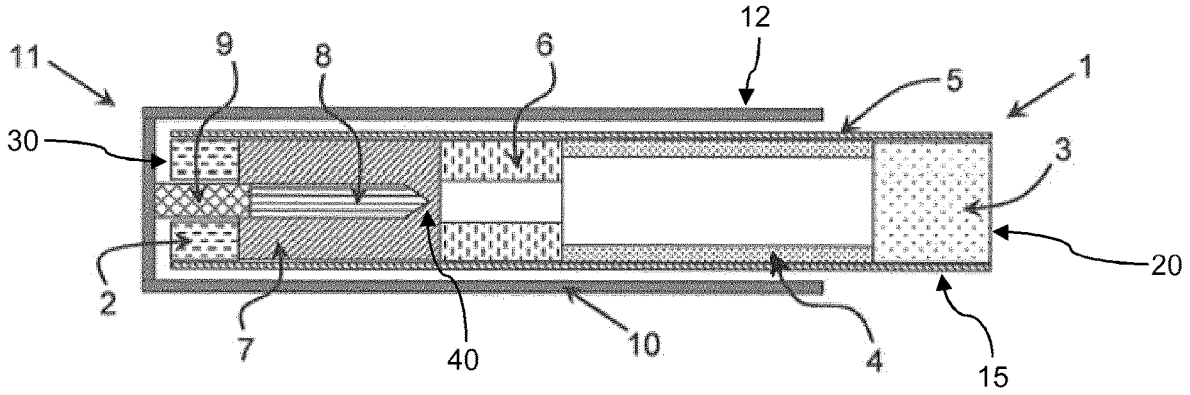
FIG. 1 is a schematic cross-sectional diagram of a smoking article according to a first embodiment engaged with an aerosol-generating device.

FIG. 1 illustrates a smoking article 1 according to a first embodiment. The smoking article 1 comprises five elements, a front-plug 2, an aerosol-forming substrate 7, a hollow cellulose acetate tube 6, a transfer section 4, and a mouthpiece filter 3. These five elements are arranged sequentially and in coaxial alignment and are assembled by a cigarette paper 5 to form a rod 15. The rod has a mouth-end 20, which a user inserts into his or her mouth during use, and a distal end 30 located at the opposite end of the rod 15 to the mouth end 20. Elements located between the mouth-end 20 and the distal end 30 can be described as being upstream of the mouth-end 20 or, alternatively, downstream of the distal end 30.

When assembled, the rod 15 is 52 millimetres long and has a diameter of 7.2 millimetres.

The front-plug 2 is a cylindrical portion of cellulose acetate tow having a length of 7 millimetres. The fibres of the cellulose acetate tow are aligned with the longitudinal direction of the rod 15.

The aerosol-forming substrate 7 is located downstream of the front-plug 2 and comprises a bundle of crimped cast-leaf tobacco wrapped in a filter paper. The cast-leaf tobacco includes additives, including glycerine as an aerosol-forming additive.

The tube 6 is located immediately downstream of the aerosol-forming substrate 7 and is formed from cellulose acetate. The tube 6 defines an aperture having a diameter of 3.3 millimetres. One function of the tube 6 is to locate the aerosol-forming substrate 7 towards the distal end 30 of the rod 15 so that it can be contacted with a heating element. The tube 6 acts to prevent the aerosol-forming substrate 7 from being forced along the rod 15 towards the mouth-end 20 when a heating element is inserted.

The transfer section 4 comprises a thin-walled tube of 18 millimetres in length. The transfer section 4 allows volatile substances released from the aerosol-forming substrate 7 to pass along the rod 15 towards the mouth end 20. The volatile substances may cool within the transfer section 4 to form an aerosol.

The mouthpiece filter 3 is a conventional mouthpiece filter formed from cellulose acetate, tow and having a length of 7 millimetres.

The five elements identified above are assembled by being tightly wrapped within a cigarette paper 5. The cigarette paper 5 in this specific embodiment is a conventional cigarette paper. For example, the cigarette paper may be a porous material with a non-isotropic structure comprising cellulose fibres (crisscross of fibres interlinked by hydrogen bonds), one or more fillers and one or more combustion agents. The one or more fillers may be, for example, calcium carbonate ($CaCO_3$) and the one or more combustion agents may be, for example, one or more of the following: potassium/sodium citrate; sodium acetate; mono-ammonium phosphate (MAP); and di-sodium phosphate (DSP). The final composition of the cigarette paper per square metre may be approximately 25 g cellulose fibres, 10 g calcium carbonate, and 0.2 g combustion agent. The porosity of the cigarette paper may be between approximately 0 Coresta and approximately 120 Coresta. The interface between the cigarette paper 5 and each of the elements locates the elements and defines the rod 15 of the smoking article 1.

Although the specific embodiment described above and illustrated in FIG. 1 has five elements assembled in a cigarette paper, it will now be clear to one of ordinary skill in the art that a smoking article according to the embodiments discussed here may have additional elements and these elements may be assembled in an alternative cigarette wrapper or equivalent. Likewise, a smoking article according to the embodiments discussed here may have fewer elements. Moreover, it will now be apparent to one of ordinary skill in the art that various dimensions for the elements discussed in relation to the various embodiments discussed here are merely exemplary, and that suitable alternative dimensions for the various elements may be chosen without deviating from the spirit of the embodiments discussed herein.

The smoking article of the first embodiment is consumed or smoked in conjunction with a suitable aerosol-generating device. FIG. 1 illustrates the smoking article when engaged with such a device 11 for consumption.

The aerosol-generating device 11 comprises a sheath 12 for receiving the smoking article 1 for consumption. A heating element 8 is located within the sheath 12 and positioned to engage with the distal end 30 of the smoking article 1. The heating element 8 is shaped in the form of a blade terminating in a point 40.

As the smoking article 1 is pushed into the sheath 12 the point 40 of the heating element 8 engages with an outer surface of the front-plug 2. By applying a force to the smoking article 1, the heating element 8 penetrates the front plug 2 and the point 40 of the heating element 8 is then brought into contact with the aerosol-forming substrate 7. The application of further pressure causes the heating element 8 to penetrate into the aerosol-forming substrate 7. Further penetration is prevented as the distal end 30 of the smoking article 1 abuts an end wall of the sheath 12, which acts as a stop.

When the smoking article 1 is properly engaged with the aerosol-generating device 11, the heating element 8 has been inserted through the front-plug 2 and is located within the aerosol-forming substrate 7 in contact with aerosol-forming material. An insulating collar 9 may surround a portion of the heating element 8 that is in contact with the front-plug 2. The collar 9 may alternatively be a cool zone provided on the length of the heating element 8. Such a collar may prevent the heating element 8 from burning or melting the front-plug 2.

Figure 2:
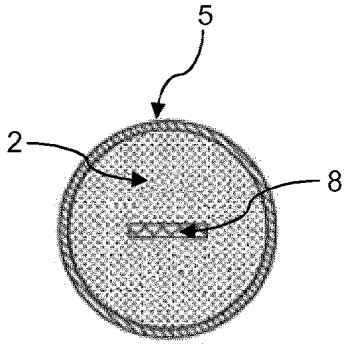
FIG. 2 is a schematic diagram illustrating a front-end projection of the smoking article according to the first embodiment, showing penetration of the front-plug of the smoking article by a heating element.

FIG. 2 is a front-end view of the smoking article 1 when engaged with the heating element 8. This view shows the cigarette paper 5 in contact with the front-plug 2. The heating element 8, which can be seen to have a blade shaped cross-section, has been inserted through the front-plug 2. The heating element 8 has deformed the cellulose acetate material forming the front-plug 2 slightly, and the resilience of this cellulose acetate material results in there being a firm contact between the front-plug 2 and outer surfaces of the heating element 8.

The aerosol-generating device 11 comprises a power supply and electronics (not shown) that allow the heating element 8 to be actuated. Such actuation may be manually operated or may occur automatically in response to a user drawing on the smoking article 1. When the heating element 8 is actuated, the aerosol-forming substrate 7 is heated and volatile substances are generated or evolved. As a user draws on the mouth end 20 of the smoking article 1, air is drawn into the smoking article 1 and the volatile substances condense to form an inhalable aerosol. This aerosol passes through the mouth-end 20 of the smoking article 1 and into the user's mouth.

The heating element 8 is heated to a temperature of about 375 degrees Celsius in order to generate an aerosol from the aerosol-forming substrate 7. As volatile substances are driven off the aerosol-forming substrate 7 by heat, the aerosol-forming substrate 7 dries out and shrinks. This can result in the aerosol-forming substrate 7 gripping the heating element 8. Simultaneously, the shrinkage of the aerosol-forming substrate 7 may cause a loss in contact with the cigarette paper 5. In the first embodiment the aerosol-forming substrate 7 is in the form of a plug, and the shrinkage causes this plug to become loose within the rod 15 of the smoking article 1.

After use, the user withdraws the smoking article 1 from the aerosol-generating device 11. The smoking article 1 is withdrawn from the sheath 12 and the heating element 8 slides out of the front-plug 2. Because the adherence between the heating element 8 and the aerosol-forming substrate 7 is greater than the adherence between the aerosol-forming substrate 7 and the cigarette paper 5, the aerosol-forming substrate 7 moves towards the distal end 30 with the heating element 8. However, the front-plug 2 blocks the path of the aerosol-forming substrate 7. This allows the heating element 8 to be withdrawn from the aerosol-forming substrate 7 without removing the aerosol-forming substrate 7 from the smoking article 1.

Particles of the aerosol-forming substrate 7 or residues derived from the aerosol-forming substrate 7 may become stuck to the heating element 8 during operation. As the heating element 8 is withdrawn from the smoking article 1, the outer surface of the heating element 8 is wiped by the front-plug 2. Thus, the heating element 8 is automatically cleaned by wiping every time a smoking article 1 is removed from the aerosol-generating device 11.

The first embodiment described above with reference to FIGS. 1 and 2 describes a smoking article 1 having its distal end 30 closed by a solid front-plug 2. Such a front-plug 2 requires a heating element 8 to be forced through the front-plug 2 to contact the aerosol-forming substrate 7.

A second embodiment of a smoking article 100 is illustrated in FIG. 3A (end view only). The smoking article 100 of FIG. 3A is identical to the smoking article 1 of the first embodiment described above apart from the configuration of the front-plug 102. The front-plug 102 is formed from cellulose acetate and is assembled in contact with a cigarette paper 5, but the front-plug 102 defines a substantially circular through-hole 103 allowing through-access to a heating element of an aerosol-generating device. The heating element can pass through the front-plug 102 with minimal insertion force required. The circular shape of the hole 103 means that there is no special orientation relationship required between the smoking article 100 and the heating element in order to engage the smoking article 100 with the aerosol-generating device.

In use, the front-plug 102 of the smoking article 100 acts in the same way as described above to prevent egress of an aerosol-forming substrate from the smoking article 100.

A third embodiment of a smoking article 200 is illustrated in FIG. 3B (end view only). The smoking article 200 of FIG. 3B is identical to the smoking article 1 of the first embodiment described above apart from the configuration of the front-plug 202. The front-plug 202 is formed from cellulose acetate and is assembled in contact with a cigarette paper 5, but the front-plug 202 defines a number of slits 203 allowing through-access to a heating element of an aerosol-generating device. The slits 203 lower the insertion force required to insert a heating element into the smoking article 200.

In use, the front-plug 202 of the smoking article 200 acts in the same way as described above to prevent egress of an aerosol-forming substrate from the smoking article 200. Furthermore, the slits 203 impinge on the heating element and effectively wipe an outer surface of the heating element when the heating element is removed from the smoking article 200, providing a cleaning effect as described above.

A fourth embodiment of a smoking article 300 is illustrated in FIG. 3C (end view only). The smoking article 300 of FIG. 3C is identical to the smoking article 1 of the first embodiment described above apart from the configuration of the front-plug 302. The front-plug 302 is formed from cellulose acetate and is assembled in contact with a cigarette paper 5, but the front-plug defines a star-shaped hole 303 allowing through-access to a heating element of an aerosol-generating device. The hole lowers the insertion force required to insert a heating element into the smoking article 300. The shape of the hole 303 allows the heating element to engage with the front-plug 302 of the smoking article 300 and prevent rotation of the smoking article 300 while it is being consumed.

In use, the front-plug 302 of the smoking article 300 acts in the same way as described above to prevent egress of an aerosol-forming substrate from the smoking article 300.

Although described above as formed from cellulose acetate, it will now be clear to one of ordinary skill in the art that the front-plugs 2, 102, 202, and 302 of the smoking articles could alternatively be formed of any suitable material or combination of materials. For example, the front-plug may be solely comprised of tobacco, a substantially tobacco comprised material, or a combination of tobacco or a substantially tobacco comprised material with another suitable material. Such materials and suitable combinations of materials will now be apparent to one of ordinary skill in the art.

The exemplary embodiments described above are not limiting. In view of the above discussed exemplary embodiments, other embodiments consistent with the above exemplary embodiments will now be apparent to one of ordinary skill in the art.

The invention claimed is:

1. A smoking article for an aerosol-generating device comprising a sheath and a heating element, the smoking article being configured to retain an aerosol-forming substrate of the smoking article in fixed relation to and in contact with a cigarette paper of the smoking article after shrinkage of the aerosol-forming substrate, the smoking article comprising:

a plurality of cylindrical elements, including a solid front-plug and the aerosol-forming substrate, assembled in contact with the cigarette paper to form a rod, the rod having a mouth end and a distal end upstream from the mouth end, the distal end being penetrated by the heating element when the distal end is inserted into the sheath, wherein the solid front-plug has a length of between 1 mm and 10 mm, has a diameter approximately equal to a diameter of the smoking article, comprises a filter material having a hole or slit defined therethrough, and is located upstream of the aerosol-forming substrate within the rod such that passage and withdrawal of the aerosol-forming substrate from the distal end of the rod is blocked, the hole or slit of the solid front-plug being penetrated by the heating element and the aerosol-forming substrate coming into contact with the heating element through the hole or slit of the solid front-plug when the distal end is inserted into the sheath, wherein the solid front-plug permits air to be drawn through the solid front-plug when the distal end is inserted into the sheath, and wherein the smoking article has two states, including:

a first state in which the aerosol-forming substrate is unheated, and in which the cigarette paper retains the plurality of cylindrical elements in position by an interference interaction in which the cigarette paper grips the plurality of cylindrical elements and holds the plurality of cylindrical elements in position within the rod, and a second state, different from the first state, in which the aerosol-forming substrate is heated and has shrunk relative to the first state, and in which the cigarette paper still retains the plurality of cylindrical elements in position by the interference interaction in which the cigarette paper grips the plurality of cylindrical elements and holds the plurality of cylindrical elements in position within the rod.

2. The smoking article according to claim 1, in which the solid front-plug has a diameter of greater than or equal to 5 mm and less than or equal to 10 mm, and a length of between 2 mm and 10 mm.

3. The smoking article according to claim 1, further comprising a filter located at the mouth end of the rod.

4. The smoking article according to claim 1, in which a material of the aerosol-forming substrate comprises processed tobacco.

5. The smoking article according to claim 1, in which the solid front-plug is configured to wipe a surface of the heating element as the heating element is withdrawn from the smoking article.

* * * * *